US006311754B1

(12) United States Patent
Marschke

(10) Patent No.: US 6,311,754 B1
(45) **Date of Patent: *Nov. 6, 2001**

(54) SINGLE FACER WITH SMALL CORRUGATING ROLL SUPPORTED BY INDEPENDENTLY MOUNTED BACKING ROLLS

(75) Inventor: Carl R. Marschke, Phillips, WI (US)

(73) Assignee: Marquip, LLC, Phillips, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/395,667

(22) Filed: Sep. 14, 1999

Related U.S. Application Data

(63) Continuation of application No. 08/854,953, filed on May 13, 1997, now Pat. No. 5,951,816, which is a continuation-in-part of application No. 08/621,998, filed on Mar. 26, 1996, now Pat. No. 5,628,865.

(51) Int. Cl.[7] ..... B31F 1/28
(52) U.S. Cl. ..... 156/472; 156/210
(58) Field of Search ..... 156/472, 470, 156/471, 473, 582, 205, 210, 462

(56) References Cited

U.S. PATENT DOCUMENTS

| | | |
|---|---|---|
| 1,264,506 | 4/1918 | Hahn . |
| 1,519,280 | 12/1924 | Wandel . |
| 1,960,677 | 5/1934 | List . |
| 2,102,937 | 12/1937 | Bauer . |
| 2,429,482 | 10/1947 | Munters . |
| 2,589,966 | 3/1952 | Rullo . |
| 2,977,247 | 3/1961 | Lutz . |
| 3,382,133 | 5/1968 | Healy . |
| 3,630,806 | 12/1971 | Kitajima et al. . |
| 3,990,935 | 11/1976 | Lehmann . |
| 4,531,996 | 7/1985 | Sukinek . |
| 5,389,183 | 2/1995 | Seki et al. . |
| 5,419,796 | 5/1995 | Miller . |
| 5,628,865 | 5/1997 | Marschke . |
| 5,728,256 | 3/1998 | Schulz et al. . |
| 5,951,816 | 9/1999 | Marschke . |

*Primary Examiner*—Michael W. Ball
*Assistant Examiner*—Gladys Piazza
(74) *Attorney, Agent, or Firm*—Andrus, Sceales, Starke & Sawall

(57) ABSTRACT

A single facer utilizes a pair of corrugating rolls, one of which is of a substantially smaller diameter. The small diameter corrugating roll is captured by a series of backing roll arrangements spaced along the axis of the smaller corrugating roll, each of which backing roll arrangements is independently supported to apply an independently variable backing load to the corrugating roll.

6 Claims, 3 Drawing Sheets

SINGLE FACER WITH SMALL CORRUGATING ROLL SUPPORTED BY INDEPENDENTLY MOUNTED BACKING ROLLS

This is a continuation of Ser. No. 08/854,953, filed May 13, 1997, now U.S. Pat. No. 5,951,816, which is a continuation-in-part of Ser. No. 08/621,998, filed Mar. 26, 1996, now Pat. No. 5,628,865.

BACKGROUND OF THE INVENTION

The present invention pertains to an apparatus for forming a single face web of corrugated paperboard and, more particularly, to a corrugating roll assembly for a single facer.

In the manufacture of corrugated paperboard, a single facer apparatus is used to corrugate the medium web, apply glue to the flute tips on one face thereof, and to bring a liner web into contact with the glued flute tips of the medium web with the application of sufficient heat and pressure to provide an initial bond. A conventional single facer typically includes a pair of fluted corrugating rolls and a pressure roll, which are aligned so the axes of all three rolls are generally coplanar. The medium web is fed between the inter-engaging corrugating rolls and the adhesive is applied to the flute tips by a glue roll while the medium is still on the corrugating roll which comprises the intermediate of the three roll arrangement. The liner web is immediately thereafter brought into contact with the adhesive-coated flute tips in the nip between the pressure roll and the corrugating roll.

As corrugating nip roll pressures and corrugating speeds have increased, changes have been made in the construction of single facers to maintain the quality of the corrugated medium and to attempt to deal with the problems of high noise and vibration. For example, the load between corrugating rolls at the corrugating nip has required that one of the fluted corrugating rolls be made with a crowned surface to accommodate roll deflection under high nip loads. Deflection as a result of high loading is also believed to be one source of noise and vibration. In a conventional single facer construction, where the two corrugating rolls and the lower pressure roll are in general alignment (their axes lying generally coplanar), corrugating roll loads are transmitted to the pressure roll adding further to the problems associated with high loads and high speeds. This has resulted, in some cases, in manufacturing the pressure roll with a negative crown to match deflections in the corrugating roll which together form the nip for joining the two single face web components.

One of the most serious problems in the operation of high speed single facers is the so-called "labyrinths" effect. In order to handle high loads and higher speeds, single facer manufacturers have gone to increasingly larger diameter, heavier and stronger corrugating rolls. As the medium web is drawn into the pressure nip, formed by the inter-engaging flutes on the two corrugating rolls, the medium web begins to be deformed, folded and gathered as it moves into the actual nip centerline where full engagement of the flutes occurs. Larger diameter corrugating rolls inherently create a more tortuous path for the web as the web begins to be wrapped partially around opposite alternating teeth or flutes of the mating corrugating rolls while moving into the fully nipped position. Each wrap of the web encompasses a slightly larger radius around the flute tip as it approaches the nip and each deformation or wrapping of the web on a flute tip adds a tension component to the overall web tension. As indicated, the additive labyrinth effect is increased as the corrugating roll diameters increase and it is not uncommon for the medium web to rupture or tear.

One proposed solution to the labyrinth problem is disclosed in U.S. Pat. No. 3,990,935. The single facer construction disclosed in this patent proposes to maintain relatively small diameter corrugating rolls to minimize the labyrinth length and to provide internally pressurized flexure compensation for the inevitable bowing to which the rolls are subjected under high corrugating nip loads. Another proposed solution to the labyrinth effect is described in U.S. Pat. No. 4,531,996. In accordance with this patent, the upper corrugating roll contact with the lower corrugating roll is "dephased" by dividing the upper roll into axially adjacent segments each of which makes nip contact with the other corrugating roll at a different point. Alternately, the dephasing effect is provided by making the segments of the upper corrugating roll of different diameters. Both of the foregoing solutions require extremely complex roll constructions. Alternately, one of the larger diameter corrugating rolls may be eliminated and other means used to stabilize a small diameter intermediate corrugating roll to provide the required nip force and prevent deflection of the small roll.

SUMMARY OF THE INVENTION

In accordance with the present invention, the labyrinth effect is minimized in a modified single facer by utilizing a small diameter corrugating roll and a larger diameter conventional corrugating roll and capturing the small diameter roll in a manner to balance the loadings and minimize roll deflection.

In accordance with one embodiment, a single facer utilizes a pair of conventional fluted main corrugating rolls mounted and operated to impose a corrugating nip force acting normal to the roll axes and generally in the plane common thereto. An intermediate fluted corrugating roll is mounted between and in rotatable engagement with both main corrugating rolls and with its axis lying generally in the same common plane. The intermediate roll forms the corrugating nip with one of the main corrugating rolls and has a diameter, as compared to the main corrugating rolls, sufficiently small to provide a reduction in the labyrinth paper path sufficient to prevent rupture of the medium web. By capturing the intermediate web corrugating roll between the two main corrugating rolls, the nip force acts to hold the smaller intermediate roll against axial bending in the common plane of their axes.

A significant reduction in the labyrinth path of the web is effected by maintaining the ratio of the diameter of the main corrugating roll and the intermediate corrugating roll which together form the nip not less than about 3:1. Preferably, one or both of the main corrugating rolls are heated and the intermediate corrugating roll may be heated as well.

The apparatus may be constructed to wrap the corrugated medium on the intermediate corrugating roll downstream of the corrugating nip to the line of engagement between the intermediate roll and the other main corrugating roll, and then back wrapped on the other main corrugating roll downstream to the point of joinder with the liner web in the pressure nip. Preferably, the intermediate corrugating roll and the other or lower corrugating roll include means for applying a vacuum to the portions of the corrugated medium wrapped thereon. The apparatus may include a pressure roll of any common construction mounted in operative rotational contact with the main corrugating roll carrying the corrugated medium. The pressure roll carries a liner web and forms with the main corrugating roll a pressure nip to join the liner web to the corrugated medium to the flute tips of which a suitable adhesive has been applied.

In a presently preferred embodiment of the single facer of the subject invention, only one large diameter fluted corrugating roll is utilized. The small diameter fluted corrugating roll, preferably having a diameter not greater than about one-third the diameter of the large corrugating roll, is positioned to interengage the large roll to create therewith a corrugating nip. In place of the other large diameter corrugating roll of the previously described embodiment, means are provided for applying a radial force to the small diameter roll generally along the axial length thereof with the resultant of the radial force creating a nip force which acts through the corrugating nip in a plane generally common to the axes of the corrugating rolls. The radial backing force also acts to restrain the small diameter roll against deflection in a manner similar to the upper of the two large corrugating rolls in the previous embodiment.

Preferably, the force applying means comprises an idler roll means which rotatably engages to small diameter corrugating roll. The idler roll means may comprise a resilient roll or rolls having a smooth outer surface in engagement with the fluted small diameter corrugating roll. Alternately, the idler roll means may comprise a fluted idler roll adapted to interengage the flutes of the small diameter corrugating roll. In the preferred embodiment, the idler roll means comprises pairs of backing rolls which are positioned along the length of the small diameter corrugating roll. The rolls of each pair are mounted on opposite sides of the plane generally common to the axes of the two corrugating rolls. Each pair of backing rolls includes its own interconnecting support. An actuator is operatively connected to each backing roll support to supply the necessary nip force. Means are provided for individually operating each actuator to vary the force applied by the backing rolls to the small diameter corrugating roll.

DETAILED DESCRIPTION OF THE PREFERRED EMBODIMENT

Figure 1:
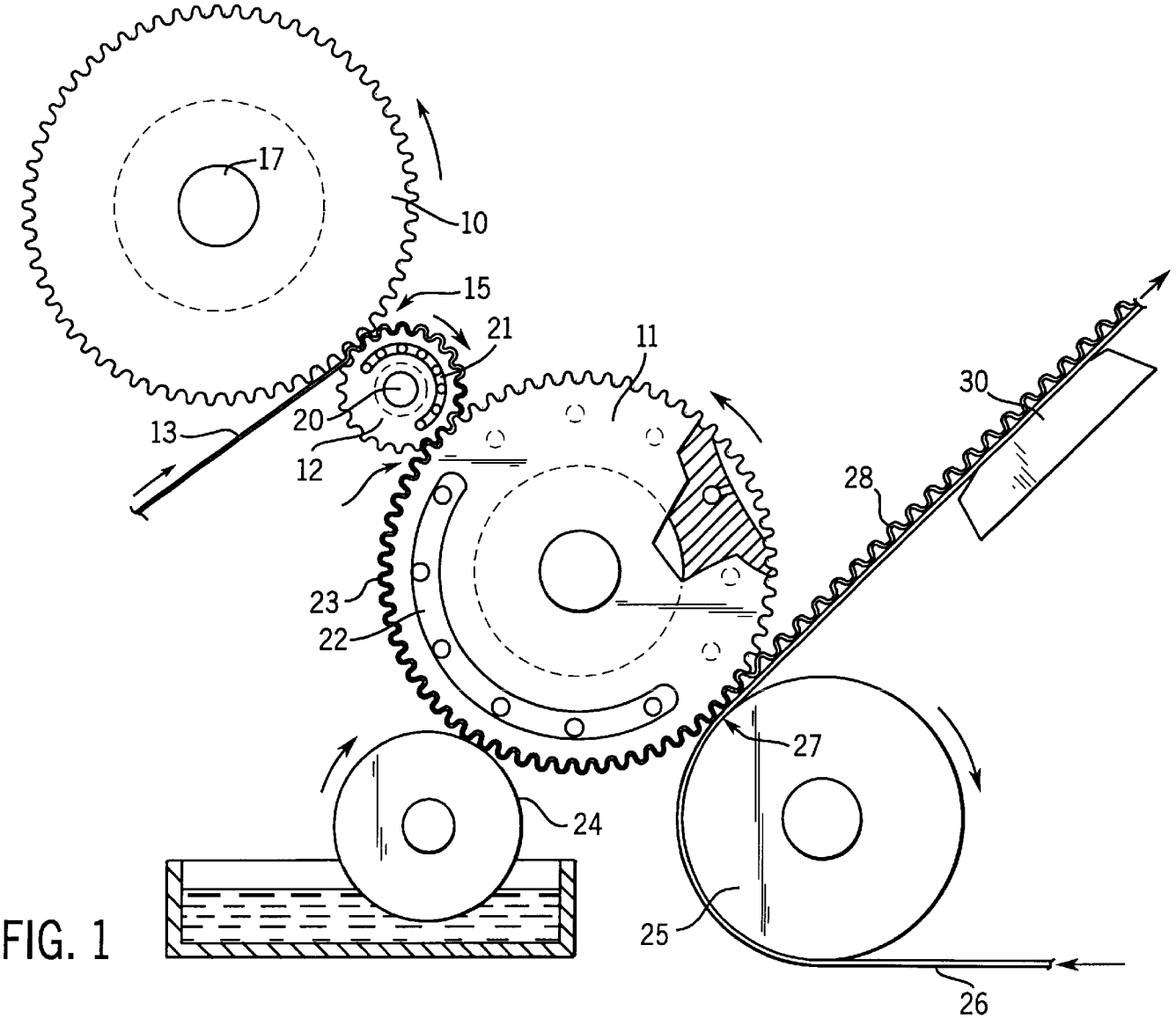
FIG. 1 is a schematic side elevation of a single facer incorporating the construction of the present invention.

In the single facer apparatus shown in FIG. 1, a conventional upper main corrugating roll 10 and lower main corrugating roll 11 are mounted in a modified position to capture therebetween and operate in rotating interengagement with a small intermediate corrugating roll 12. Each of the rolls 10–12 is provided with a conventional fluted peripheral surface with the flutes of each roll being of the same size, shape and pitch. In accordance with standards in the corrugated paperboard industry, flute configurations vary in terms of pitch dimension (number of flutes per foot) and flute depth (crown to root dimension). In the U.S., the configurations range from A-flute having 33 to 35 flutes per foot and a flute depth of 0.185 inch (4.7 mm) to E-flute having 90 to 96 flutes per foot and a flute depth of 0.045 inch (1.1 mm). A corresponding pitch dimension range from A-flute to E-flute is about ⅓ inch (approximately 8 mm) to about ⅛ inch (about 3 mm).

For many years, single facers have been made with a single pair of corrugating rolls, such as rolls 10 and 11 which were counterrotated to create a corrugating nip therebetween. A paper medium web 13 is fed directly into the nip and corrugated in the usual manner. Also until relatively recently, the diameters of the inter-engaging corrugated roll pair did not exceed about 12 inches (about 30 cm). However, as corrugator line speeds increased with a concomitant need to increase the speed of the single facer, corrugating roll diameters were increased to as large as 18 inches (about 46 cm) or more.

Figure 2:
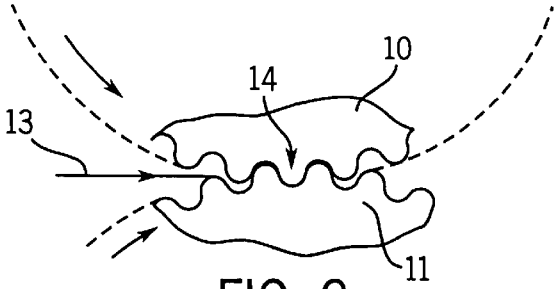
FIG. 2 PRIOR ART
FIG. 2 is a schematic representation of the labyrinth path in corrugating rolls of the prior art.
Figure 3:
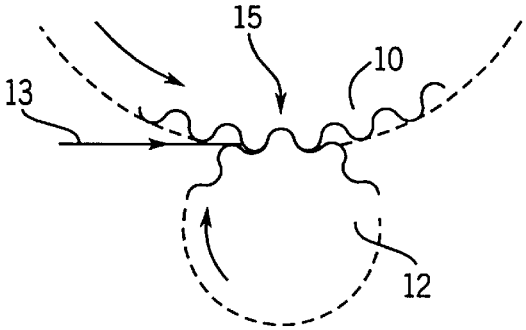
FIG. 3 is a schematic representation of the labyrinth path in the corrugating rolls of the present invention.

Referring also to FIGS. 2 and 3, there is shown schematically the generation of the so-called labyrinth path which the medium web 13 follows as it is pulled into the corrugating nip. Each of the FIGS. 2 and 3 illustrations utilizes interengaging corrugating rolls having flutes of the same pitch and shape, the only differences being in the diameter of one corrugating roll in each pair. FIG. 2 shows the medium web moving generally tangentially into the corrugating nip between two equal and relatively large diameter corrugating rolls, such as main rolls 10 and 11 in FIG. 1, if repositioned. As the diameter of a corrugating roll increases, its arc or pitch circle naturally tends to straighten or flatten. As the medium web 13 is drawn into the nip 14, it begins to be gathered and folded by contact with the flutes of both rolls upstream of the nip. Thus, before the web reaches its final corrugated flute shape at the centerline of the nip 14, it has already been subjected, in the illustrated embodiment, to some degree of folding or wrapping around three flute tips in addition to the fully interengaged flute tip pair at the nip. This is what is referred to in the industry as the labyrinth path. The wrapping of the web around each flute tip creates added tension in the web and these tension forces are additive. The forces are calculated in accordance with the function $e^{82}\ \beta$, where $\mu$ is the coefficient of friction and $\beta$ is the angle of wrap around the arcuate flute tip in radians. As corrugating roll diameters have increased to match corrugator speeds and nip loadings, the labyrinth paths have increased to the point where excess tension in the web often results in rupture of the medium web at the nip.

In accordance with the present invention, the interposition of the small diameter corrugating roll 12 between the upper and lower corrugating rolls 10 and 11 has the effect of considerably reducing the labyrinth path length and the corresponding build up of additive web tension. The modified single facer still utilizes larger high speed and high strength corrugating rollers which capture the small diameter intermediate roll 12 therebetween. As shown in FIG. 3, the length of the labyrinth path into the modified corrugating nip 15, formed by inter-engagement of the upper main corrugating roll 10 and the smaller diameter intermediate corrugating roll 12, is substantially reduced in length. As may be seen, the medium web 13 is partially wrapped on only two flute tips (in addition to the fully engaged pair at the nip 15) resulting in a labyrinth length significantly shorter than the length of the labyrinth in the FIG. 2 illustration. It is also believed that as the number of reverse bends imparted to the medium web as it travels through the serpentine labyrinth path increases with corrugating roll diameter increase, the problem of increasing tensile force on the web is compounded.

By maintaining the relatively large diameters of the upper and lower main corrugating rolls 10 and 11, high corrugating speeds and the resistance of the rolls to deflection may be retained. As shown in FIG. 1, the assembly of the three corrugating rolls 10–12 results in their rotational axes lying generally in a common plane. This plane also passes through the corrugating nip 15 and the corresponding nip 16 between the intermediate roll 12 and the lower corrugating roll 11. It should be noted that because the medium web 13 passing through nip 16 has already been corrugated, there is no labyrinth effect in nip 16. With main corrugating rolls 10 and 11 manufactured to larger diameters with inherently improved resistance to axial bending in the common plane, smaller and lower strength intermediate corrugating roll 12 is captured therebetween and held against axial bending or deformation in that plane. It is believed that the three roll assembly of the present invention may even allow the elimination of expensive crowned corrugating roll constructions. It is possible, if desired, to substantially increase the diameter of the upper corrugating roll 10 (and the lower corrugating roll 11 as well) to, for example, 24 inches (in excess of 60 cm). Correspondingly, the smaller intermediate corrugating roll 12 may have a diameter as small as 6 inches (about 15 cm), but may have a diameter of 8 inches (20 cm) or larger. It is believed that a ratio of diameters of upper corrugating roll 10 to intermediate corrugating roll 12 of at least about 3:1 is desirable. This ratio may, however, be varied considerably depending on overall medium web strength and roll speeds. Variation in flute type may also have some effect, but the benefits of labyrinth path length reduction provided by the subject invention are applicable to all flute types.

The remaining construction of the single facer utilizing the subject invention may be generally conventional. Thus, one or all of the corrugating rolls 10, 11 and 12 may be internally heated with steam, as through connections in their respective axial supporting shafts 17,18 and 20, all in a manner well known in the art. Preferably, both the intermediate corrugating roll 12 and the lower main corrugating roll 11 are provided with conventional vacuum systems by which vacuum is applied, via suitable networks of axial and radial vacuum passages 21 and 22, to the corrugated medium 23 wrapped thereon to help maintain its shape and position. The glue roll 24 of a conventional glue applicator makes rotating contact with the flute tips of the corrugated medium 23 on the lower corrugating roll 11. A liner web 26 is carried around a portion of a pressure roll 25 where it is brought into contact with the glued flute tips of the corrugated medium 23 in the pressure nip 27 formed by the pressure roll 25 and the lower corrugating roll 11. The pressure roll 25 may be of a conventional construction and positioned with its axis generally in the same plane as the axes of the corrugating rolls 10–12. Alternately, other pressure roll constructions may also be used, including a low pressure nip roll with supplemental curing of the resultant single face web 28 such as in downstream web heating device 29, as disclosed in my U.S. Pat. No. 4,500,900 entitled "Vacuum Assisted Web Drying System" , issued Feb. 11, 1997; or my co-pending application entitled "Pressure Roll for a Single Facer" filed on the same date as this application.

Figure 5:
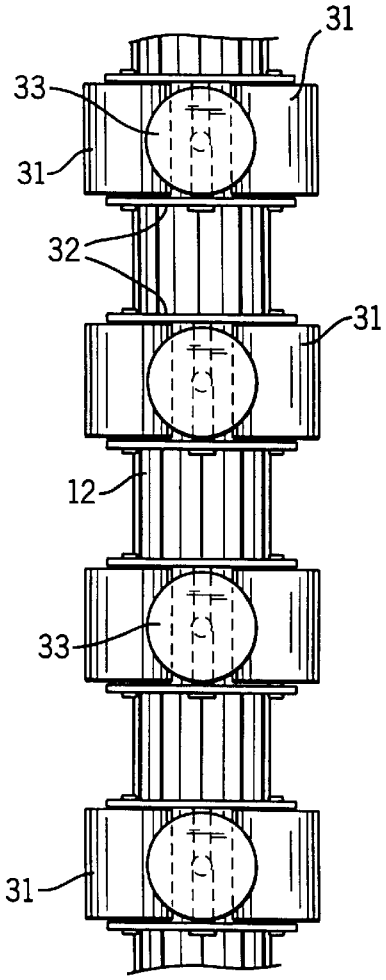
FIG. 5 is a generally top plan view taken on line 5—5 of FIG. 4.
Figure 4:
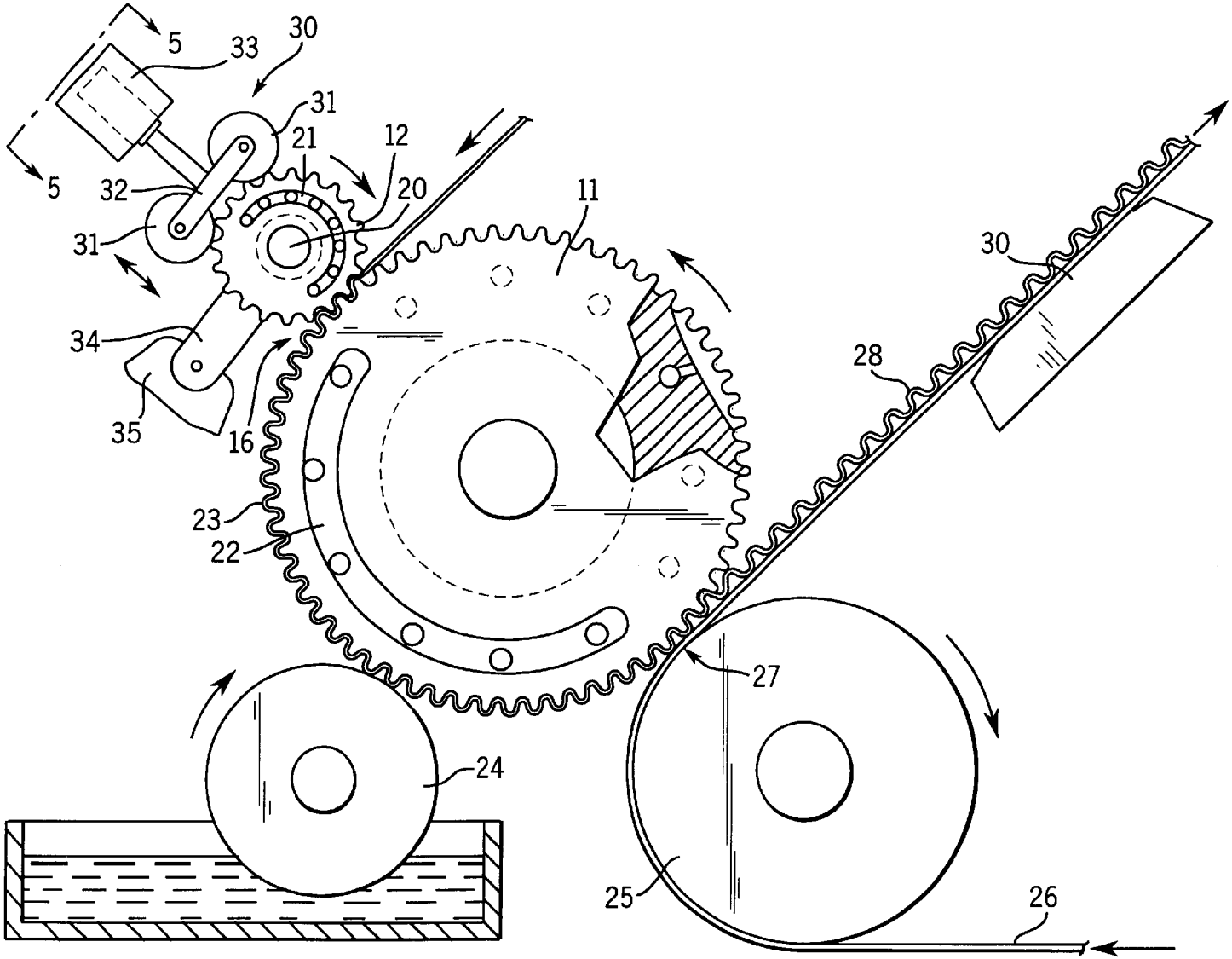
FIG. 4 is a schematic side elevation of a single facer incorporating the construction of the presently preferred embodiment of the invention.

Referring now to FIGS. 4 and 5, the small diameter intermediate corrugating roll 12 may be utilized in a modified single facer construction with only a lower corrugating roll 11 and with the upper corrugating roll of the previous embodiment replaced with a modified backing roll arrangement 30. In this presently preferred embodiment, the nip 16 between the small intermediate corrugating roll 12 and the larger diameter lower corrugating roll 11 becomes the corrugating nip. The medium web 13 is thus fed from a direction opposite the web in the FIG. 1 embodiment and directly into the nip 16. From that point, the corrugated medium 23 is handled in exactly the same manner as in the FIG. 1 embodiment.

To provide the necessary corrugating nip force, the backing roll arrangement 30 is positioned and operated to provide a downward force against the small corrugating roll 12, the resultant of which force acts through the corrugating nip generally in the plane common to the axes of both corrugating rolls 11 and 12. The backing roll arrangement 30 preferably applies a force along the full axial length of the small diameter corrugating roll 12 to provide a uniform nipping pressure or force and a uniform backing force which restrains the small corrugating roll against deflection normal to its axis.

The backing roll arrangement 30 includes a series of pairs of idler rolls 31, with each pair attached to a mounting bracket 32 such that the rolls are mounted on opposite sides of the common plane through the corrugating roll axes. The idler rolls 31 are positioned to bear directly on the outside of the fluted small diameter corrugating roll 12. The opposite axial ends of the small corrugating roll 12 are supported on the ends of a pair of pivot arms 34, the opposite ends of which are pivotally attached to the machine frame 35. Each idler roll pair includes a pneumatic cylinder 33 operatively attached to the mounting bracket 32 to impose a selectively variable force on the idler rolls and thus on the small corrugating roll 12.

The idler rolls 31 may comprise a hard rubber or rubber-like material to help reduce noise and vibration. The cylindrical outside surfaces of the idler rolls 31 may be smooth, as indicated, or may be provided with flutes to match the flute pattern of the corrugating roll 12 engaged by the idler rolls.

Although a plurality of pairs of idler rolls is preferred, as indicated, a pair of full length backing rolls could be used or a single full length roll positioned generally in the same manner as the large upper corrugating roll 10 of the FIG. 1 embodiment. The corrugating nip force and the force necessary to restrain the small corrugating roll against deflection may also be provided by an alternate backing means, such as an air bearing. In another embodiment, the intermediate corrugating roll 12 could be provided with a series of axially spaced annular grooves which interrupt the flute pattern and in which grooves narrow idler rolls (similar to roll pairs 31) are positioned to operate and provide the indicated backing force.

I claim:

1. In a single facer apparatus for producing a single face corrugated web, including first and second fluted corrugating rolls rotatable on parallel spaced roll axes with flutes adapted to interengage to form a corrugating nip for a paper web, means rotatably mounting said first and second corrugating rolls to impose a corrugating nip force normal first and second corrugating to the roll axes generally in the plane common thereto, the improvement comprising:

said first corrugating roll having a diameter sufficiently smaller than the diameter of said second corrugating roll to provide a reduction in the labyrinth paper path sufficient to prevent rupture of a medium web; and, a plurality of backing roll means in operative rotatable engagement with said first corrugating roll for applying a backing force to said first corrugating roll sufficient to provide the nip force and to restrain the first corrugating roll against deflection, said plurality of backing roll means each independently supported to impose the backing force along substantially the full axial length of said first corrugating roll.

2. The apparatus as set forth in claim 1 wherein said plurality of backing roll means comprises:

a plurality of pairs of backing rolls positioned along the length of said first corrugating roll, the rolls of each pair positioned on opposite sides of the plane common to the first and second corrugating roll axes; and, support means providing common support for each roll pair.

3. The apparatus as set forth in claim 2 comprising an actuator operatively connected to each roll pair support means to impose a variable backing force thereon.

4. A single facer apparatus for producing a single face corrugated web from a medium web and a liner web, said apparatus comprising:

a large diameter fluted corrugating roll;

a small diameter fluted corrugating roll having a diameter not greater than about one-third the diameter of said large diameter roll and positioned to interengage said large diameter roll to create therewith a corrugating nip; and, force applying means for independently applying a plurality of axially spaced radial forces to said small diameter roll along substantially the full axial length thereof, the resultant of said radial forces creating a nip force acting through the corrugating nip in a plane generally common to the axes of said corrugating rolls, said radial force restraining said small diameter roll against deflection.

5. The apparatus as set forth in claim 4 wherein said force applying means comprises:

pairs of backing rolls positioned along the length of said small diameter roll and in operative rotatable engagement therewith, the rolls of each pair mounted on opposite sides of said common plane; and, a support for each pair of backing rolls.

6. The apparatus as set forth in claim 5 wherein said force applying means comprises an actuator operatively connected to each backing roll support; and, means for individually operating each actuator to vary the force applied to said small diameter roll.

* * * * *

UNITED STATES PATENT AND TRADEMARK OFFICE

CERTIFICATE OF CORRECTION

PATENT NO. : 6,311,754 B1
DATED : November 6, 2001
INVENTOR(S) : Carl R. Marschke It is certified that error appears in the above-identified patent and that said Letters Patent is hereby corrected as shown below:

Column 6, claim 1,
Line 54, after "normal" insert -- to the --.
Line 55, delete "to the".

Signed and Sealed this

Ninth Day of April, 2002

*Attest:*

*Attesting Officer*

JAMES E. ROGAN
*Director of the United States Patent and Trademark Office*